US009464864B2

(12) United States Patent
Merlino et al.

(10) Patent No.: US 9,464,864 B2
(45) Date of Patent: Oct. 11, 2016

(54) RIFLE INTERNAL ACCESSORY MOUNTING APPARATUS, SYSTEM, AND METHOD

(71) Applicant: HARDENED ARMS LLC, Friday Harbor, WA (US)

(72) Inventors: Patrick Merlino, Friday Harbor, WA (US); Richard Merlino, Friday Harbor, WA (US)

( * ) Notice: Subject to any disclaimer, the term of this patent is extended or adjusted under 35 U.S.C. 154(b) by 0 days.

(21) Appl. No.: 14/311,170

(22) Filed: Jun. 20, 2014

(65) Prior Publication Data

US 2015/0247700 A1 Sep. 3, 2015

Related U.S. Application Data

(60) Provisional application No. 61/956,915, filed on Jun. 20, 2013.

(51) Int. Cl.
*F41C 23/00* (2006.01)
*F41C 23/16* (2006.01)

(52) U.S. Cl.
CPC ..... *F41C 23/16* (2013.01)

(58) Field of Classification Search
USPC ..... 42/71.01, 72, 75.01
See application file for complete search history.

(56) References Cited

U.S. PATENT DOCUMENTS

| | | | | |
|---|---|---|---|---|
| 5,590,484 | A * | 1/1997 | Mooney et al. | 42/111 |
| 6,543,172 | B1 * | 4/2003 | Armstrong | F41C 23/22 42/71.01 |
| 6,931,775 | B2 * | 8/2005 | Burnett | F41C 27/00 42/106 |
| 8,037,633 | B1 * | 10/2011 | Troy | 42/71.01 |
| 8,429,845 | B1 * | 4/2013 | Swan | 42/90 |
| 2014/0196342 | A1 * | 7/2014 | Syrengelas | F41C 7/02 42/71.01 |

* cited by examiner

*Primary Examiner* — J. Woodrow Eldred
(74) *Attorney, Agent, or Firm* — AEON Law; Adam L. K. Philipp

(57) ABSTRACT

Fore-end half stock (hand guard) internal rail mounts for a rifle allows rifle accessories to be internally attached to the hand guard. Internal rails are positioned about the axis of the rifle barrel to align the rifle accessory.

16 Claims, 24 Drawing Sheets

RIFLE INTERNAL ACCESSORY MOUNTING APPARATUS, SYSTEM, AND METHOD

FIELD

This disclosure relates to rifle accessory mounting systems, in particular, to internal accessory mounting systems for rifles.

BACKGROUND

Existing rifle accessory mounting systems use a barrel hand guard that provides a rail to connect external mounting brackets that can be attached to various rail-mounted accessories. The combination of mounting bracket and accessory are often heavy and may unbalance the rifle.

BRIEF DESCRIPTION OF THE DRAWINGS

The aspects of the present disclosure are best understood from the detailed description when read in relation to the accompanying drawings. The drawings illustrate a variety of different aspects, features, and embodiments of the disclosure, as such it is understood that the illustrated embodiments are merely representative and not exhaustive in scope. The disclosure will now be described with reference to the accompanying drawings, wherein like numbers refer to like elements.

DETAILED DESCRIPTION

Figure 1:
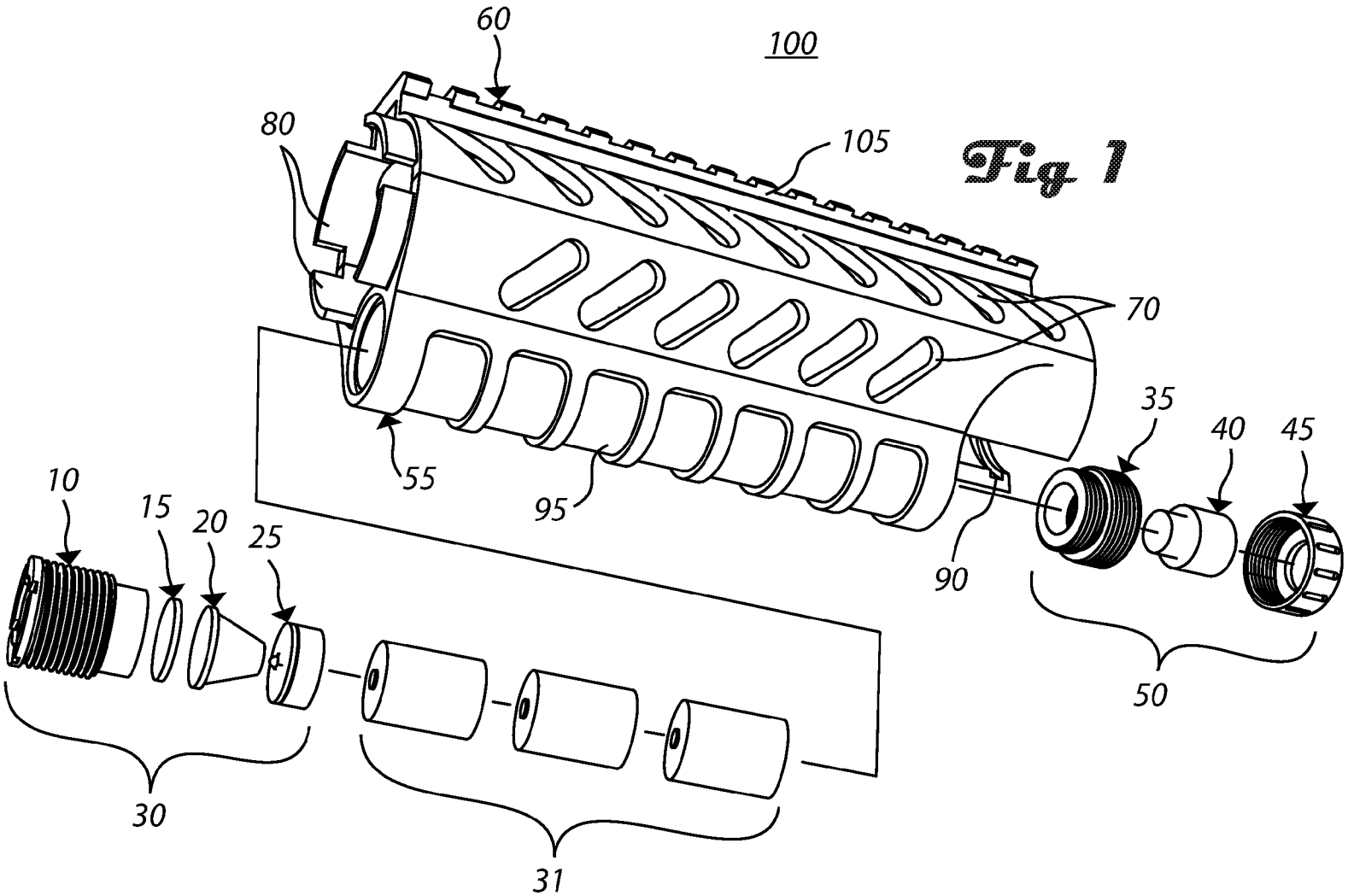
FIG. 1 illustrates an exploded perspective view of a two piece hand guard with a single internal accessory mount, a tail cap assembly and a head assembly accessory in accordance with at least one embodiment.

In accordance with various embodiments of the invention, internal rifle accessory mounting systems and methods are described that overcome the hereinafore-mentioned disadvantages of the heretofore-known external rifle accessory mounting methods and systems of this general type and that provide for fore-end half stock with at least one internal rail. More specifically, the described embodiments provide at least one internal rail that reduces the weight of the mounting bracket, aligns the accessory (e.g., a light source or camera), and maintains balance of the rifle. In one embodiment, each internal rail includes threaded inserts to receive a variety of rifle accessories.

Reference is now made in detail to the description of the embodiments as illustrated in the drawings. In the following detailed description, reference is made to the accompanying drawings which form a part hereof wherein like numerals designate like parts throughout, and in which are shown, by way of illustration, specific embodiments in which the disclosure may be practiced. Various aspects of the illustrative embodiments will be described using terms commonly employed by those skilled in the art to convey the substance of their work to others skilled in the art. However, the embodiments described herein may be practiced with only some of the described aspects. For purposes of explanation, specific numbers, materials, and configurations may be set forth to provide a thorough understanding of the illustrative embodiments. However, the embodiments described herein may be practiced without the specific details. In other instances, well-known features are omitted or simplified in order not to obscure the illustrative embodiments. Further, various operations may be described as multiple discrete operations, in turn, in a manner that may be helpful in understanding the embodiments described herein; however, the order of description should not be construed as to imply that these operations are necessarily order dependent. In particular, these operations need not be performed in the order of presentation.

Referring to FIG. 1, a perspective view of a two piece hand guard 100 including a top hand guard 60, bottom hand guard 55 with an internal accessory mount, a head assembly 30, batteries 31, and a tail cap assembly 50 is shown in accordance with at least one embodiment. In one embodiment the internal accessory mount 55 includes a grip enhancing feature 95, a front mounting interface 80, a rear mounting features 90, and heat dispersion features 70. In one embodiment, the head assembly 30 includes a front accessories fixture 10, lens cover 15, lens 20, and illumination package 25. The head assembly 30 attaches to internal accessories mount 55 from the left of FIG. 1. In one embodiment, head assembly 30 is protected from being damaged, caught on clothing and/or other objects by being flush mounted and low profile when mounted to internal accessory mount 55. In one embodiment, batteries 31 are secured/encapsulated inside internal mount system 55 by head assembly 30 and/or tail cap assembly 50. In one embodiment, batteries 31 are inserted into the internal accessory mount 55 from the left of FIG. 1. In at least one other embodiment, batteries 31 can be inserted into the internal accessory mount 55 from the right of FIG. 1. In one embodiment, the tail cap assembly 50 includes rear accessory fixture 35, switch package 40, and switch cover 45. The tail cap assembly 50 attaches to internal accessories mount 55 from the right of FIG. 1. In one embodiment, tail cap assembly 50 is protected from snagging, damage, and accidental activation by being recessed into internal accessories mount 55. The direct attachment of head assembly 30 and tail cap assembly 50 to the internal accessory mount 50 provides a simple and lightweight accessory system without the need for bulky adapters. In one embodiment, batteries 31 include but not limited to three (3) stacked CR123A batteries. Depending on voltage needed the configuration and style of power source used may be adapted to the device and internal rail mounting system.

Illustrated in FIG. 1 is a two piece system allowing mounting to rifles. In this embodiment mounting is achieved utilizing the front mounting feature 80 and the rear mounting feature 90 which holds the two piece hand guard 100 in place. In other embodiments, the internal accessories mount 55/hand guard 100 could be secured by a variety of mechanical attachments such as screws, cam(s), quick disconnect, adhesive, threads, jam nut, or some combination of these. In at least one embodiment, the two piece hand guard 100 could be made to fit other firearms, paintball guns, air soft guns, or any device designed to emit a projectile by changing the front mounting interface 80 and or the rear mounting interface 90 to accommodate the required mounting system. In the illustrated embodiment the grip enhancing feature 95 is depicted as rounded rectangular machined features. In at least one embodiment, grip enhancing features 95 could also include machining into square, round, triangular, rectangular reliefs to the top hand guard 60 and/or the internal accessories mount 55. In at least one embodiment, other types of grip enhancing features 95 are used, such as grip tape, knurling, or other textures designed to further enhance grip. These grip enhancements could be used in conjunction or in place of the depicted grip enhancing feature 95. In one embodiment, the top hand guard 60 includes a Picatinny rail 105 and heat dispersion features 70. In at least one embodiment, top hand guard 60 could omit the Picatinny rail 105 and/or heat dispersion features 70 shown in FIG. 1. As shown, heat dispersion features 70 are rounded rectangles (ovals). In other embodiments, vent holes shown as heat dispersion features 70 can be arranged in a variety of patterns such as round, square, rectangular, triangular, or other geometric shape, designed to allow heat to escape, however some rifles may not need vents and they become decorative in nature if included. The internal accessories mount 55 can be made from at least one of the following materials: metal, polymer, rubber, wood, carbon fiber, fiberglass, or some combination of these.

In one embodiment, the head assembly 30 is comprised of the front accessories fixture 10, the lens cover 15, the lens 20 and the illumination package 25. In at least one embodiment, the head assembly 30 may include a variety of different devices including aim assisting device(s), global positioning devices(s), marking indicators(s), signal emitting devices(s), transponder(s), projectile device(s), and or sensor(s). In the illustrated embodiment, the front accessories fixture 10 is shown using a threaded attachment designed to match the internal accessories mount 55. In other embodiments, a device could use cam(s), friction, quick disconnects, set screw(s), adhesive, mechanical attachment or some combination of these instead of the threaded attachment to be secured to internal accessories mount 55. In other embodiments, the head assembly 30 may be round, square, rectangular, triangular or some combination of these shapes. In at least one embodiment, the adapter free mounting system of the internal accessories mount 55 allows the quick detachment and attachment of head assembly 30. In at least one other embodiment, batteries 31 could be a proprietary power cell. In at least one other embodiment, batteries 31 could be comprised of other commercial and/or industrial power cells. In at least one other embodiment, batteries 31 could be omitted, in place of a connection to an external power supply.

As shown the tail cap assembly 50 consists of a rear accessories fixture 35, switch package 40, and switch cover 35. In at least one embodiment, tail cap assembly 50 may include electronic adapters, remote switch interfaces, pressure switch, electrical plugs, waterproof plugs, switching devices, sensors, aim assist devices, global position device(s), marking indicators, signal emitting devices, transponders, external power adapters, projectile devices or a combination of these. In one embodiment, the rear accessories fixture 35 utilizes threads to attach to the internal accessories mount 55. In at least one embodiment, a device could use cam(s), friction, quick disconnects, set screw(s), adhesive, mechanical attachment or some combination of these to be secured to the internal accessories mount 55. In at least one embodiment, the tail cap assembly 50 may be round, square, rectangular, triangular or some combination of these shapes. In at least one embodiment, tail cap assembly 30 can be quickly changed out to a different configuration of tail cap assembly 30 without the use of adapters or tools.

Figure 2:
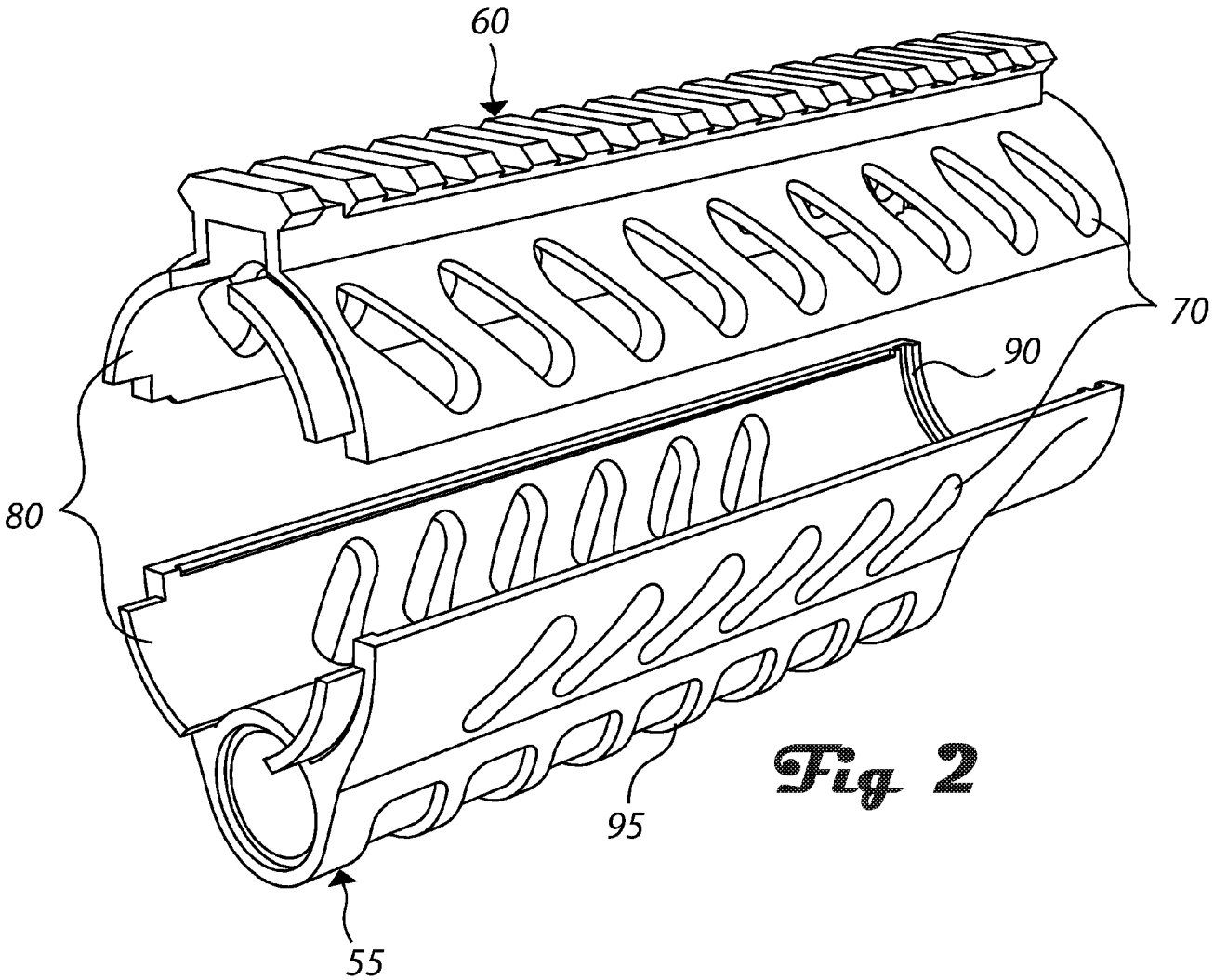
FIG. 2 illustrates an exploded perspective view of a two piece hand guard with a single internal accessory mount in accordance with at least one embodiment.

Referring to FIG. 2, a perspective view of top hand guard 60 and internal accessory mount 55 is shown in accordance with at least one embodiment. In one embodiment the adjoining edges of top hand guard 60 and internal accessory mount 55 align and are held together once affixed to a rifle using the front mounting fixture 80 and/or the rear mounting fixture 90. In at least one embodiment, top hand guard 60 and internal accessory mount 55 could be fastened together independently of the front mounting fixture 80 or the rear mounting fixture 90. Fastening of top hand guard 60 and the internal accessory mount 55 could be secured together using various methods such as screws, cam(s), friction, quick disconnects, adhesive, mechanical attachment or some combination of these. Optional heat dispersion features 70 are also show in both the top hand guard 60 and the internal accessory mount 55.

Figure 3:
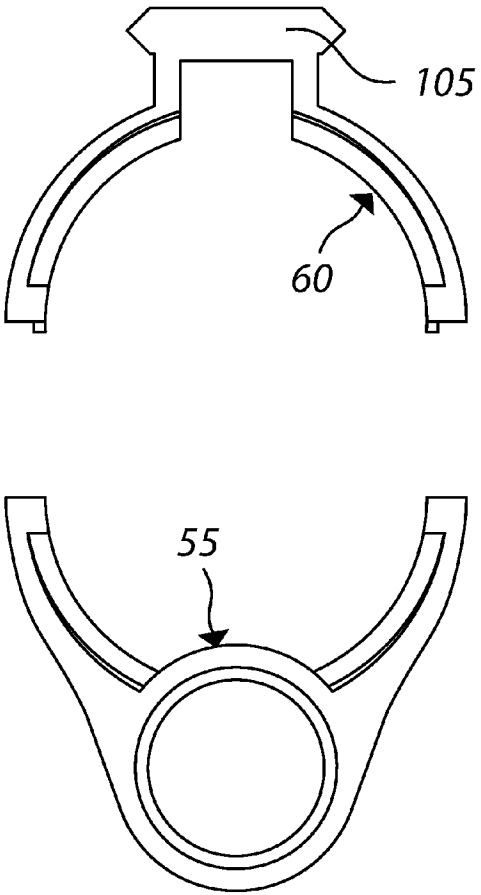
FIG. 3 illustrates an exploded front view of a two piece hand guard with a single internal accessory mount in accordance with at least one embodiment.

Referring to FIG. 3, a front view of top hand guard 60 and the internal accessory mount 55 are shown according to one embodiment. In one embodiment, internal accessories mount 55 centers the accessory mount at the bottom of the rail creating a compact and integrated mount point. In at least one other embodiment, the single mount point on internal accessories mount 55 could be on the side and/or offset from center line while remaining in line with the barrel of the firearm. In at least one other embodiment, the top hand guard 60 could include an accessory mount centered, offset and/or concentrically located on the side. Placement of the single accessory mount at any point along the circumference of top hand guard 60 and/or internal accessories mount 55 allows for a low profile light weight accessories mounting point that is snag free and fully integrated in hand guard 100. Utilizing the single accessory mount point an accessory can be mounted internally without the use of adapters or bulky mounting points.

Figure 4:
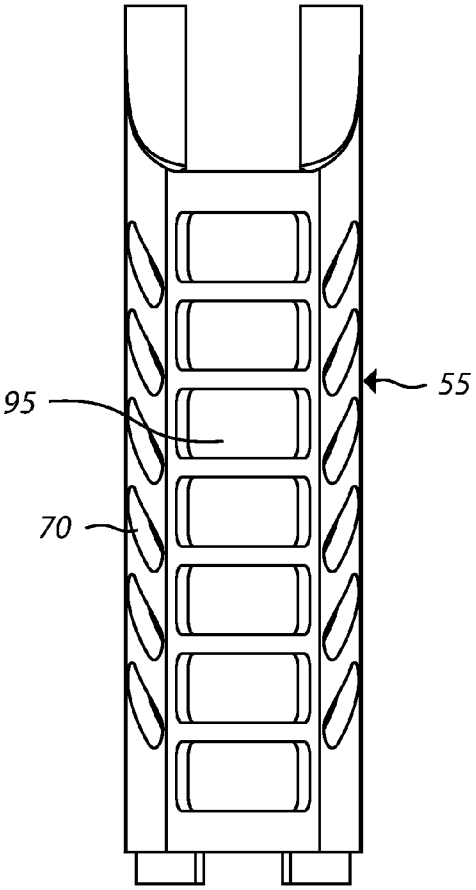
FIG. 4 illustrates a bottom view of a two piece hand guard with a single internal accessory mount in accordance with at least one embodiment.

Referring to FIG. 4, a bottom view of the internal accessory mount 55 is shown according to one embodiment. Optional grip enhancing feature 95 allows for a more positive grasp of internal accessory mount 55 by the operator and/or can help prevent the firearm from slipping when propped against a barricade. In other embodiments, grip enhancing feature 95 could be shaped as squares, circles, ovals, triangles and/or any combination of shapes that enhance grip. In at least one other embodiment, grip enhancing feature 95 could encompass the entire outer surface or a portion thereof internal accessory mount 55 (not shown).

Figure 5:
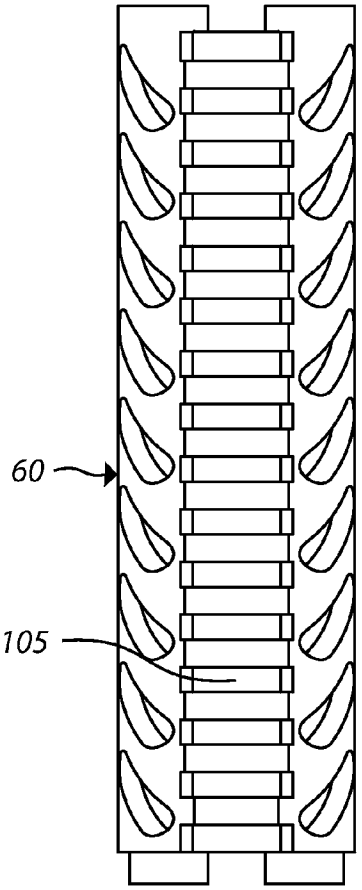
FIG. 5 illustrates a top view of a two piece hand guard with a single internal accessory mount in accordance with at least one embodiment.

Referring to FIG. 5, a top view of the top hand guard 60 is shown according to one embodiment. In one embodiment, top hand guard 60 shows optional heat dispersion features 70 allowing heat to be vented from top hand guard 60. Due to the proximity of the barrel of the firearm to top hand guard 60 venting may or may not be necessary to adequately cool the firearm. In one embodiment, Picatinny rail 105 is located at the top center of top hand guard 60. The optional Picatinny rail 105 is designed to line up and extend the Picatinny rail feature present on most firearms. In at least one other embodiment, Picatinny rail 105 could be omitted from top hand guard 60. In at least one other embodiment, Picatinny rail 105 could be replaced with heat dispersion features 70 for better cooling. In at least one other embodiment, Picatinny rail 105 could be replaced for grip enhancing features 95. In at least one other embodiment, Picatinny rail 105 could be replaced with any form of mounting interface such as m-lok, keymod, and/or any combination of industry standard weapon accessory mounts (not shown).

Figure 6:
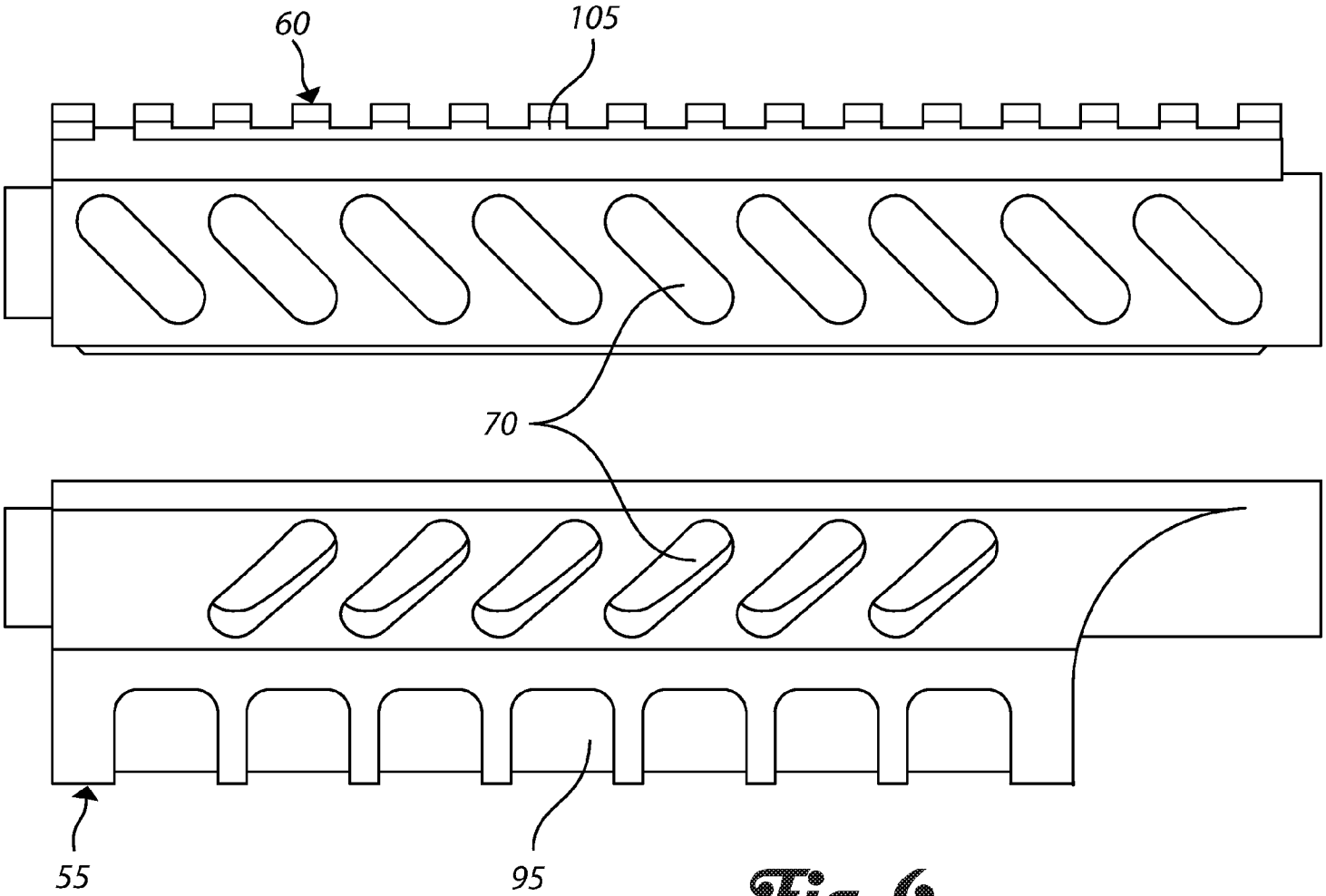
FIG. 6 illustrates an exploded side view of a two piece hand guard with a single internal accessory mount in accordance with at least one embodiment.

Referring to FIG. 6, a side view of top hand guard 60 and the internal accessory mount 55 is shown according to one embodiment. In one embodiment, Picatinny rail is centered along the top of top hand guard 60 allowing for attachment points of standard sights and/or aim assisting optics. In at least one other embodiment, Picatinny rail 105 could be along the side and/or offset at an angle on top hand guard 60 and/or internal accessories mount 55 (not shown). In at least one other embodiment, heat dispersion features 70 may be omitted and/or become decorative features. In at least one embodiment, heat dispersion features 70 may also act as grip enhancement breaking up the smooth surface of top hand guard 60 and/or internal accessories mount 55.

Figure 7:
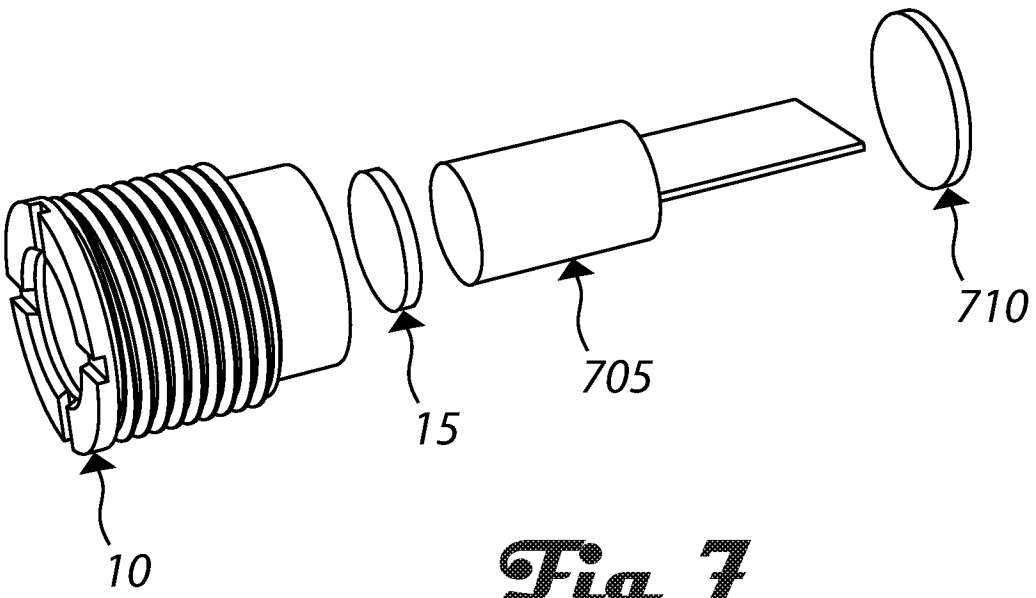
FIG. 7 illustrates an exploded perspective view of a laser equipped head assembly in accordance with at least one embodiment.

Referring to FIG. 7, a perspective view of a front accessory fixture 10, a lens cover 15, a laser module 705 and a laser battery end cap 710 is shown according to one embodiment. In one embodiment, FIG. 7 illustrates a representative device that is designed to mount to the internal accessory mount 55. In one embodiment, laser module 705 acts as an aim-assisting and/or marking device selectively projecting a beam of laser light through lens cover 15 and front accessory fixture 10. In one embodiment, the laser battery end cap 710 provides electrical contacts to power the laser module 705. In at least one embodiment, laser battery end cap 710 and front accessory fixture 10 can serve to protect laser module 705 from dust, debris, liquids and foreign objects.

Figure 8:
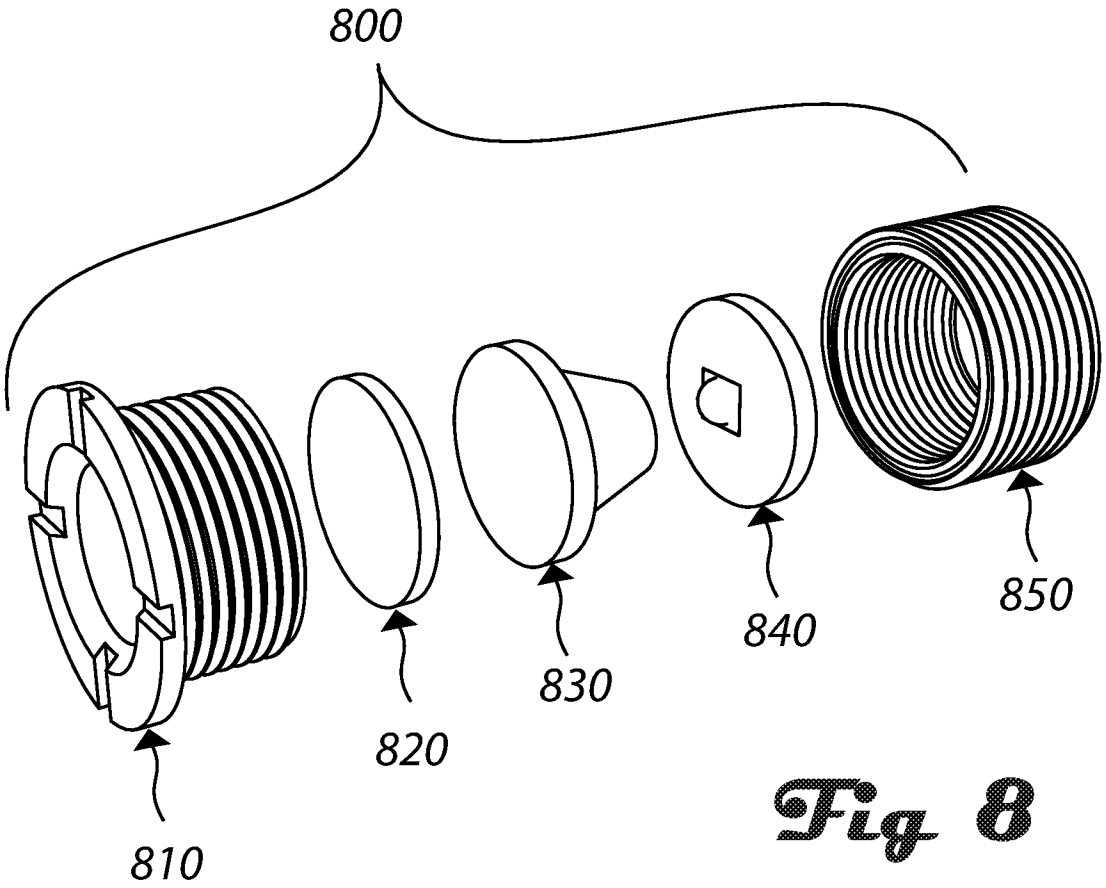
FIG. 8 illustrates an exploded perspective view of a variation of a head assembly in accordance with at least one embodiment.

Referring to FIG. 8, a perspective view of a two piece head assembly 800 is shown in accordance with at least one embodiment. The two piece head assembly 800 includes a front fixture 810 of a two-piece front accessory, a lens cover 820, lens 830, electronic package 840, and a rear fixture 850 of the two-piece front accessory. In at least one embodiment, the two piece head assembly 800 may include a variety of different devices including an aim assisting device(s), global positioning devices(s), marking indicators(s), signal emitting devices(s), transponder(s), projectile device(s), and or sensor(s). In the illustrated embodiment, the two piece front accessory rear fixture 850 is shown using a threaded attachment designed to match the internal accessories mount 55. In other embodiments, a device could use cam(s), friction, quick disconnects, set screw(s), adhesive, mechanical attachment or some combination of these instead of the threaded attachment to be secured to internal accessories mount 55. In one embodiment, the two piece front accessory fixture 810 screws into the rear fixture 850 of the two piece front accessory, housing and securing lens cover 820, lens 830 and electronic package 840 inside. In at least one embodiment, lens cover 820 could be omitted. In at least one embodiment, lens 830 could be omitted. In at least one embodiment, the two piece head assembly 800 shows the versatility of device mount configurations to the internal accessory mount 55 shown in FIG. 1 while still using threads.

Figure 9:
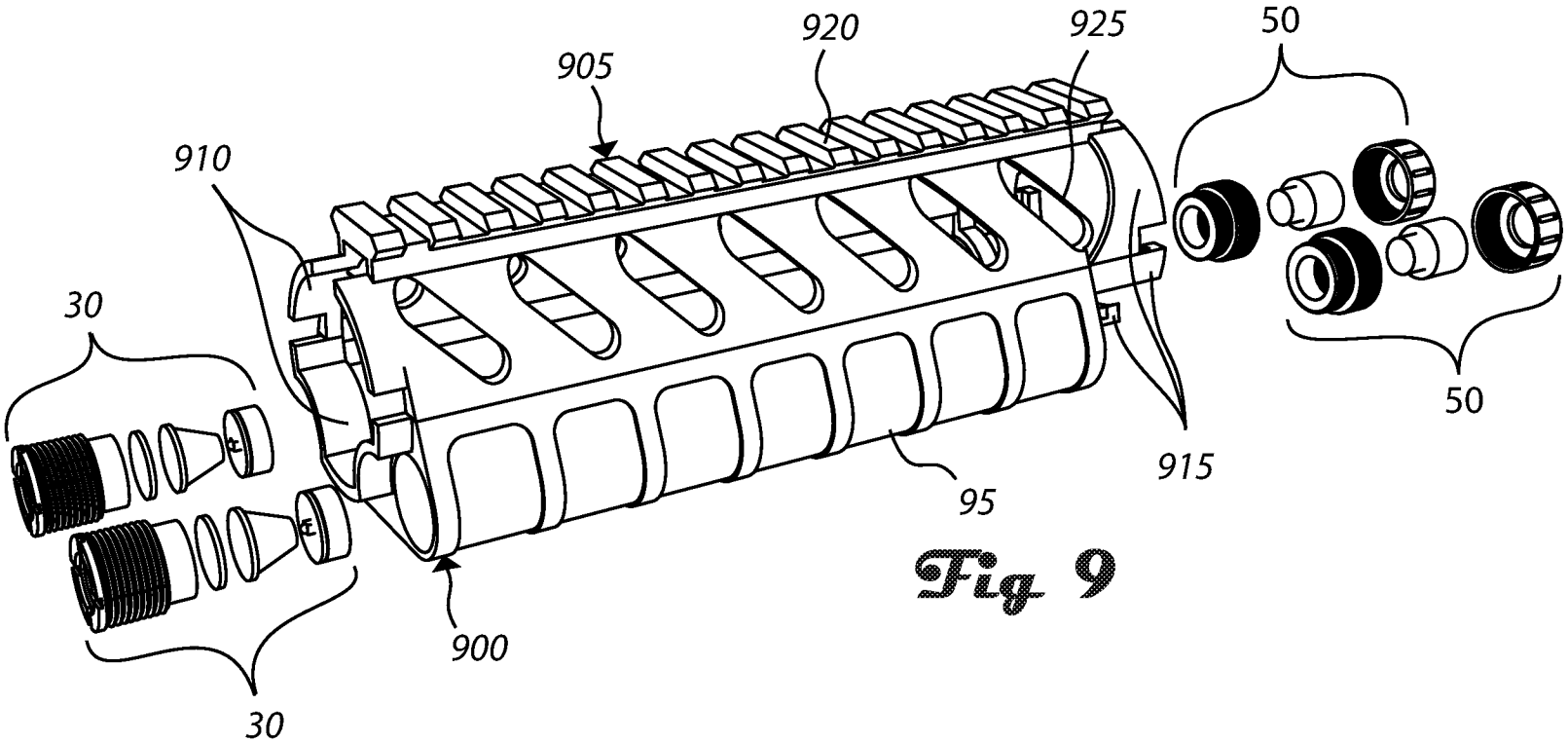
FIG. 9 illustrates an exploded perspective view of a two piece hand guard with dual internal accessory mounts, two head assemblies, and two tail cap assemblies in accordance with at least one embodiment.

Referring to FIG. 9, a perspective view is shown of a dual internal accessory mount 900 with a dual top hand guard 905, two head assemblies 30, and two tail cap assemblies 50. In one embodiment, the dual internal accessory mount 900 is configured to receive two head assemblies 30 and two tail cap assemblies 50 that may be affixed to the dual internal accessory mount 900. In one embodiment, the dual internal accessory mount 900 includes a grip enhancing feature 95, dual front mounting fixture 910, dual rear mounting fixture 915. In one embodiment, dual top hand guard 905 includes Picatinny rail 920, venting features 925, dual front mounting fixture 910, and dual rear mounting fixture 915. In at least one embodiment, batteries 31 (not shown) are housed inside dual internal accessory mount 900. In at least one embodiment, batteries 31 fit in either/or both sides of the dual internal accessory mount to provide power to head assemblies 30 and/or tail cap assemblies 50.

In at least one embodiment, the dual internal accessory mount 900 can include one or more mount points to secure different variations of a head assembly 30. In at least one embodiment, the dual internal accessory mount 900 can include one or more mount points to secure tail cap assembly 50. In at least one other embodiment, dual internal accessory mount 900 can be machined to allow three, four or more head assemblies 30 and/or tail cap assemblies 50. In at least one embodiment, the dual top hand guard 905 could omit the Picatinny rail 920 and/or venting features 925 shown in FIG. 9. As shown, venting features 925 are rounded rectangles (ovals). In other embodiments, vent holes shown as vent features 925 can be arranged in a variety of patterns such as round, square, rectangular, triangular, or other geometric shape, designed to allow heat to escape, however some rifles may not need vents and they become decorative in nature if included. The dual internal accessories mount 900 can be made from at least one of the following materials: metal, polymer, rubber, wood, carbon fiber, fiberglass or some combination of these.

Figure 10:
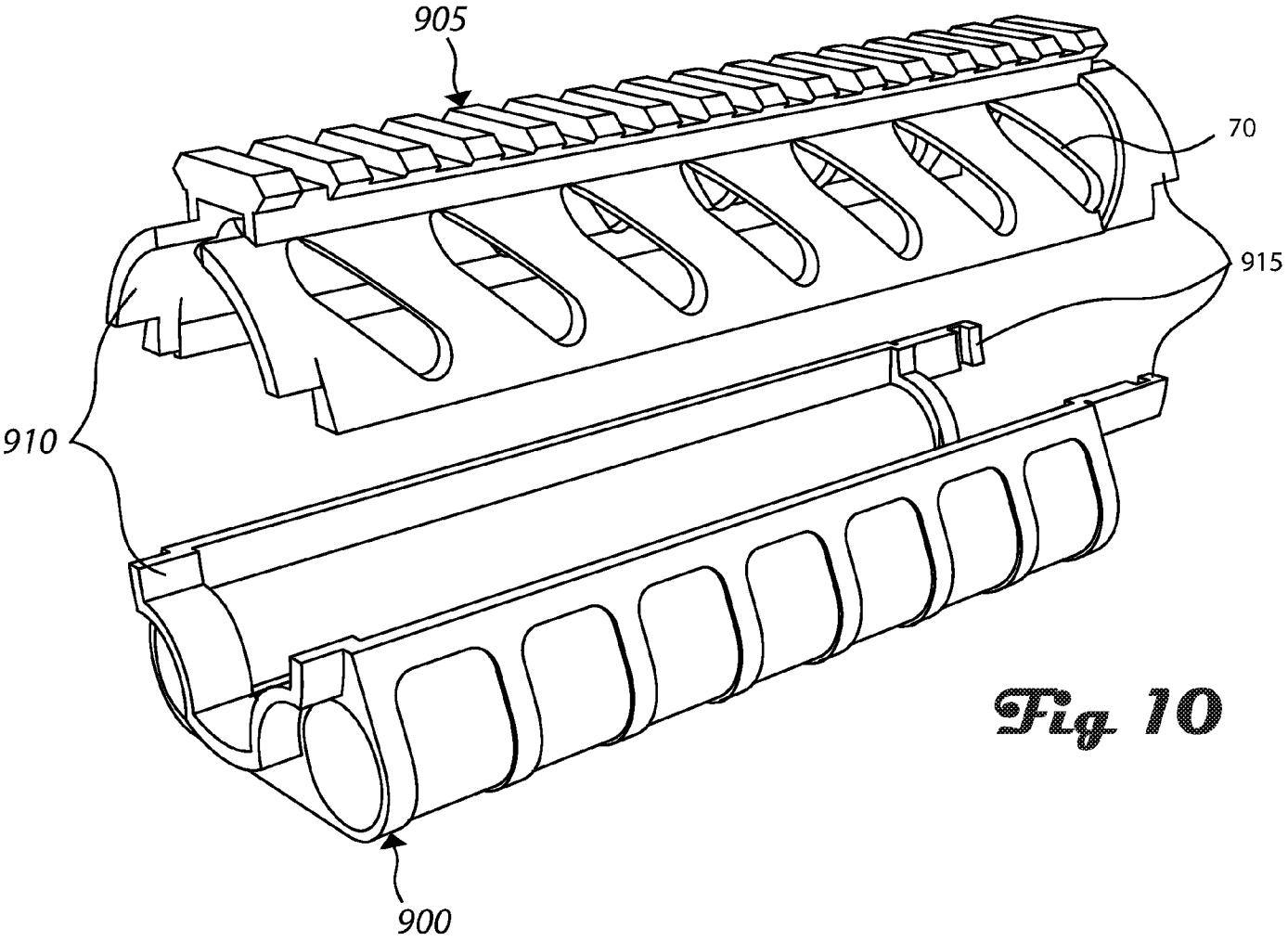
FIG. 10 illustrates an exploded perspective view of a two piece hand guard with dual internal accessory mounts in accordance with at least one embodiment.

Referring to FIG. 10, an exploded perspective view of a dual top hand guard 905 and a dual internal accessory mount 900 is shown in accordance with at least one embodiment. In one embodiment, the adjoining edges of dual top hand guard 905 and dual internal accessory mount 900 align and are held together once affixed to a rifle using the front mounting fixture 910 and/or the rear mounting fixture 915. In at least one embodiment, the dual top hand guard 905 and dual internal accessory mount 900 could be fastened together independently of the front mounting fixture 910 and/or the rear mounting fixture 915. Fastening of the dual top hand guard 905 and the dual internal accessory mount 900 could be secured together using various methods such as screws, cam(s), friction, quick disconnects, adhesive, mechanical attachment or some combination of these.

Figure 11:
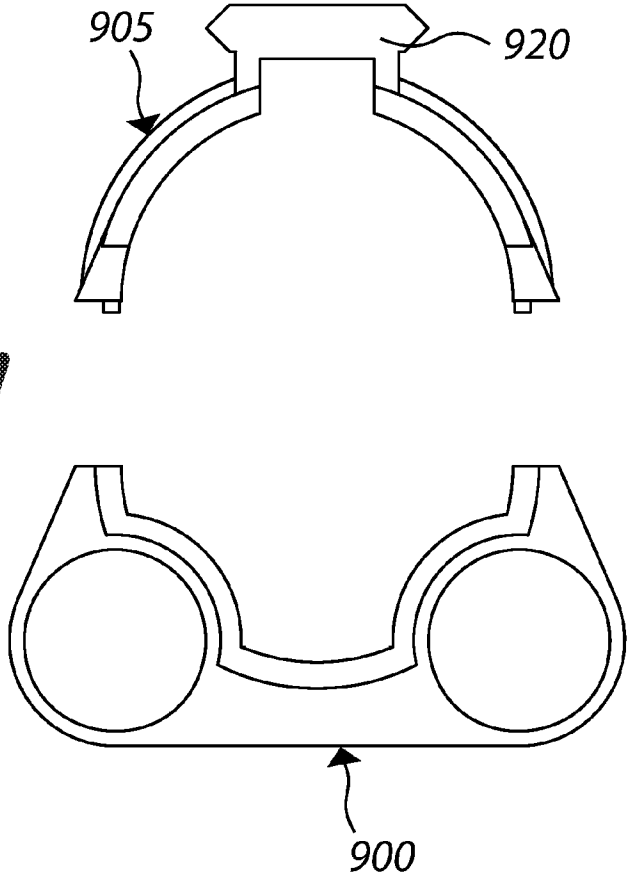
FIG. 11 illustrates an exploded front view of a two piece hand guard with dual internal accessory mounts in accordance with at least one embodiment.

Referring to FIG. 11, a front view of dual top hand guard 905 and dual internal accessory mount 900 is shown according to one embodiment. In one embodiment, the two internal mounts in the dual internal accessory mount form an ergonomic handhold for the firearm. In one embodiment, Picatinny rail 920 is centered at the top of dual top hand guard 905. In at least one other embodiment, Picatinny rail 920 could be located off center, on the side, or omitted from dual top hand guard 905. In other embodiments, the internal mounts can be located offset from the center line on either side. In at least one other embodiment, both internal accessory mounts could be located on one side. In other embodiments, the dual internal accessory mounts could be located on the dual top hand guard 905 in a variety of placement configurations running parallel to the barrel. In at least one other embodiment, placement of the internal mount locations in dual internal accessory mount 900 may result in a non-ergonomic design, such as the space between the mount points being hollow, omitted, thinner, thicker, wider, skinnier or some combination of these.

Figure 12:
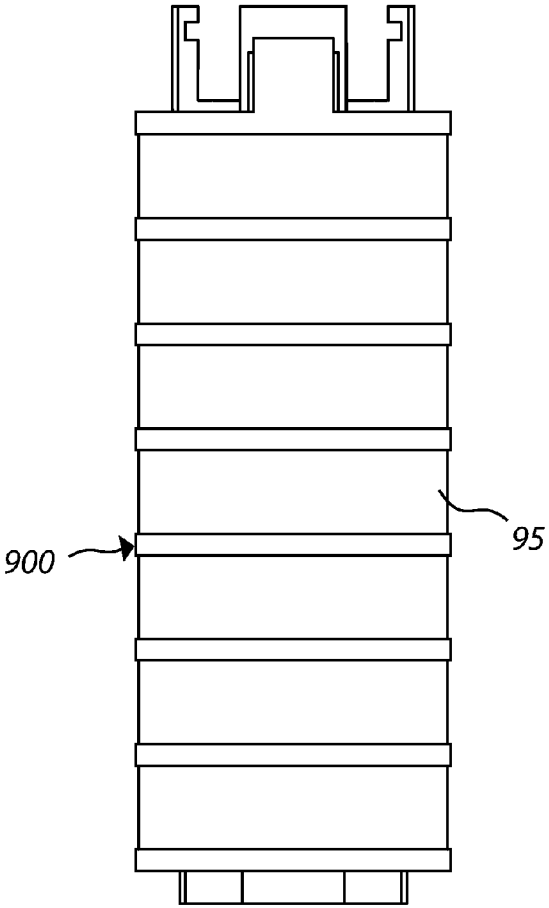
FIG. 12 illustrates a top view of a two piece hand guard dual internal accessory mount showing only the bottom of the two pieces in accordance with at least one embodiment.

Referring to FIG. 12, a top view of dual internal accessory mount 900 is shown according to one embodiment. In one embodiment, grip enhancing feature 95 wraps around the bottom and onto the sides of dual internal accessory mount 900. In other embodiments, grip enhancing features 95 can be a variety of sizes to aid in handling of the attached firearm, up to but not limited to being omitted from the design. The grip enhancing features 95 shown in FIG. 12 are found to be the optimum pattern for function and aesthetics. In at least one other embodiment, grip enhancing features 95 could be square, round, rectangular, triangular or a combination of these shapes. In at least one embodiment, a Picatinny rail 920 (not shown) could be added center bottom, offset or on the side on dual internal accessory mount 900.

Figure 13:
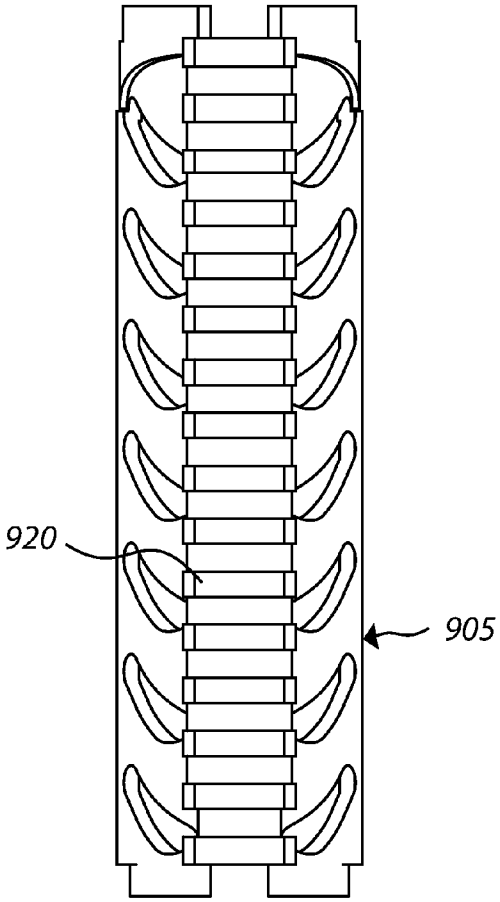
FIG. 13 illustrates a top view of a two piece hand guard with dual internal accessory mounts in accordance with at least one embodiment.

Referring to FIG. 13, a top view of dual top hand guard 905 is shown according to one embodiment. In one embodiment, Picatinny rail 920 is located top center of dual top hand guard 905. In other embodiments, Picatinny rail 920 could be located on the side and/or offset of dual top hand guard 920. In at least one other embodiment, Picatinny rail 920 could be omitted from dual top hand guard 905.

Figure 14:
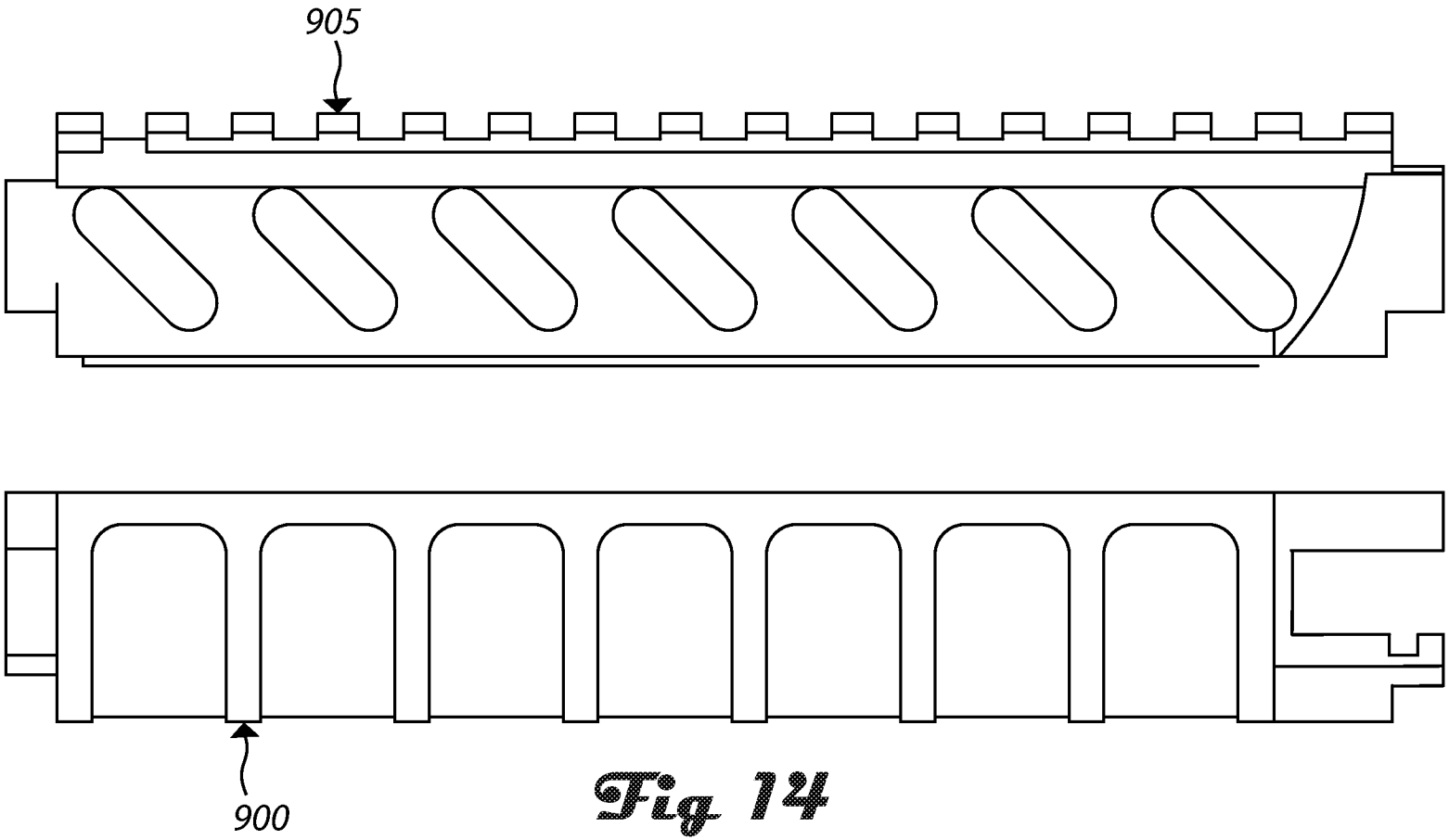
FIG. 14 illustrates an exploded side view of a two piece hand guard with dual internal accessory mounts in accordance with at least one embodiment.

Referring to FIG. 14, a side view of dual top hand guard 905 and the internal accessory mount 900 is shown according to one embodiment.

Figure 15:
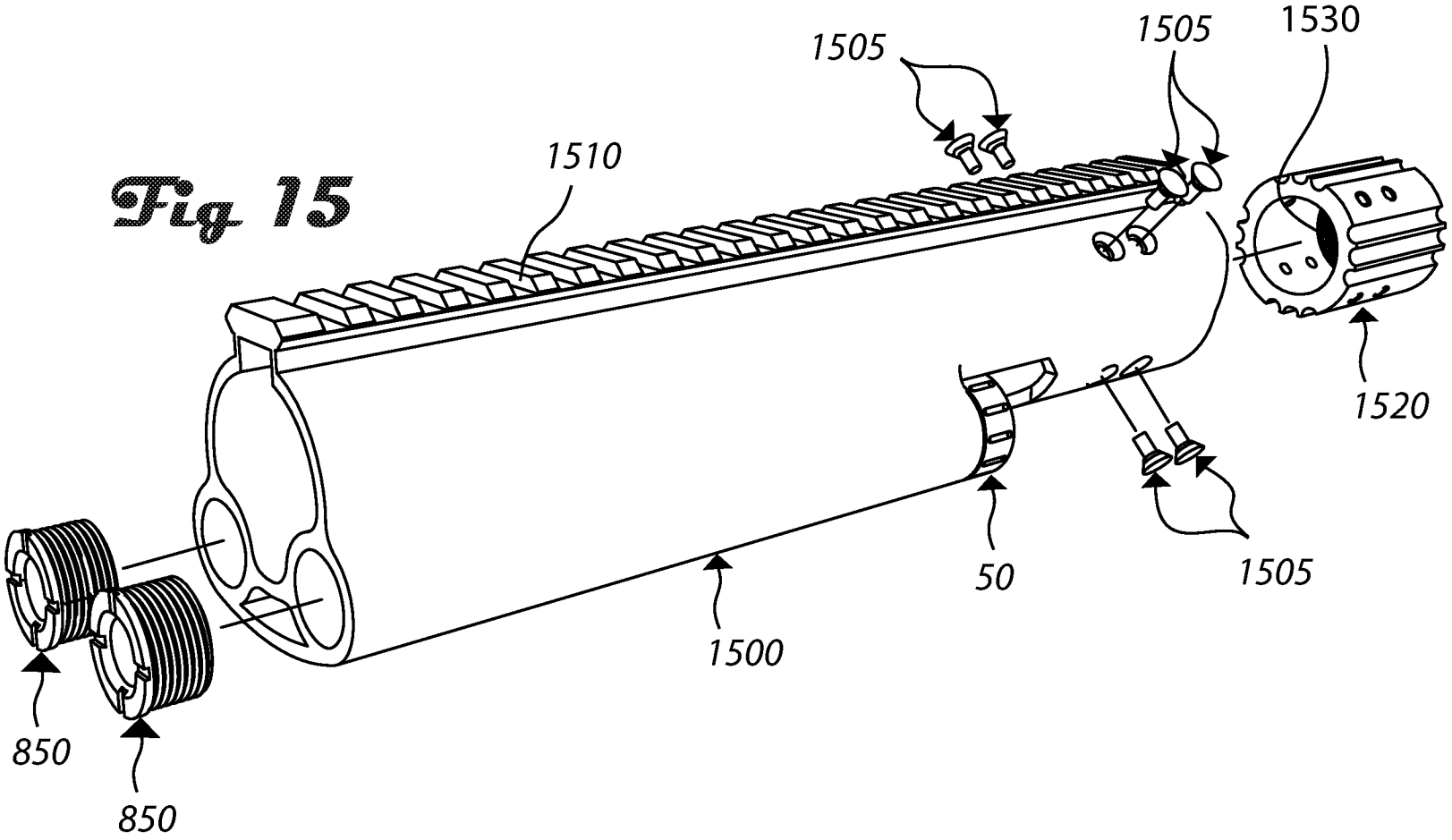
FIG. 15 illustrates an exploded perspective view of a free float dual internal accessory mount, barrel nut mounting system in accordance with at least one embodiment.

Referring to FIG. 15, an exploded perspective view of a free float dual internal accessory mount 1500 is shown in accordance with one embodiment. In one embodiment, the free float dual internal accessory mount 1500 includes (two) two piece head assemblies 800, barrel nut screws 1505, tail cap assembly 50, a barrel nut 1520, and a Picatinny rail 1510. In one embodiment, the free float dual internal accessory mount 1500 provides mounting points for two separate two-piece head assembly 800 devices. In one embodiment, the free float dual internal accessory mount 1500 provides mounting points for up to two tail cap assembly 50 devices. In one embodiment, the free float dual internal accessory mount 1500 includes Picatinny rail 1510. In one embodiment, the free float dual internal accessory mount 1500 is affixed to a rifle, airsoft gun, paintball gun, and/or other projectile emitting devices by means of barrel nut 1520 and barrel nut screws 1505. In one embodiment, mounting by barrel nut 1520 permits the barrel of the firearm to pass through the center of free float dual internal accessory mount 1500 without imparting pressure and deviating accuracy. In one embodiment, the barrel nut 1520 is secured to a rifle, airsoft gun, paintball gun, and/or other projectile emitting devices using threaded feature 1530. In at least one embodiment, the barrel nut 1520 can be secured to a rifle by means of cam(s), friction, quick disconnects, set screw(s), adhesive, mechanical attachment or some combination of these. In at least one embodiment, free float dual internal accessory mount 1500 can be secured to barrel nut 1520 by cam(s), friction, quick disconnects, set screw(s), adhesive, mechanical attachment or some combination of these. In at least one embodiment, free float dual internal accessory mount 1500 could omit Picatinny rail 1510. Various embodiments of the free float dual internal accessories mount 1500 can be made from at least one of the following materials: metal, polymer, rubber, wood, carbon fiber, fiberglass or some combination of these. The barrel nut 1520 can be made from at least one of the following materials: metal, polymer, rubber, wood, carbon fiber, fiberglass or some combination of these. In one embodiment, dual free float internal accessory mount 1500 is shown without heat dispersion venting. In at least one other embodiment, heat dispersion venting 70 can be added to free float dual internal accessory mount 1500 (not shown). In at least one other embodiment, free float internal accessory mount 1500 could have grip enhancing features 95 (not shown).

Figure 16:
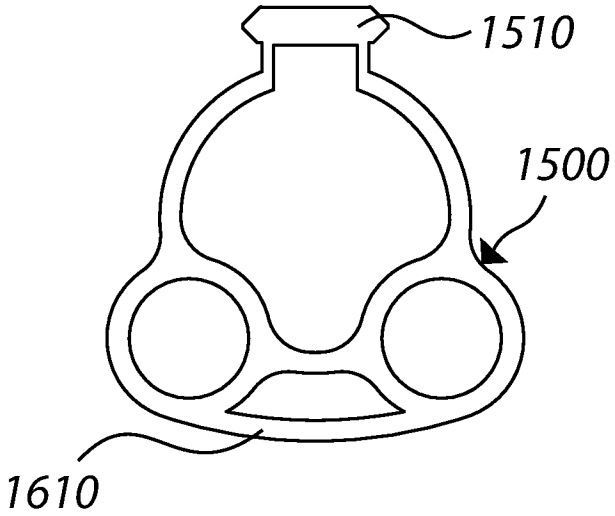
FIG. 16 illustrates a front view of a free float dual internal accessory mount in accordance with at least one embodiment.

Referring to FIG. 16, a front view of free float dual internal accessory mount 1500 is shown according to one embodiment. In one embodiment, the two internal mounts in free float dual internal accessory mount 1500 provide for two head assemblies 80 (not shown) to be mounted in a low profile, snag free configuration. In one embodiment, free float dual internal accessory mount 1500 is made ergonomic and lightweight by internal mount web 1610. In one other embodiment, internal web mount 1610 could be shaped a number of different ways to better grip and/or ergonomics for the operator. In one other embodiment, internal mount web 1610 could be omitted from free float internal accessory mount 1500.

Figure 17:
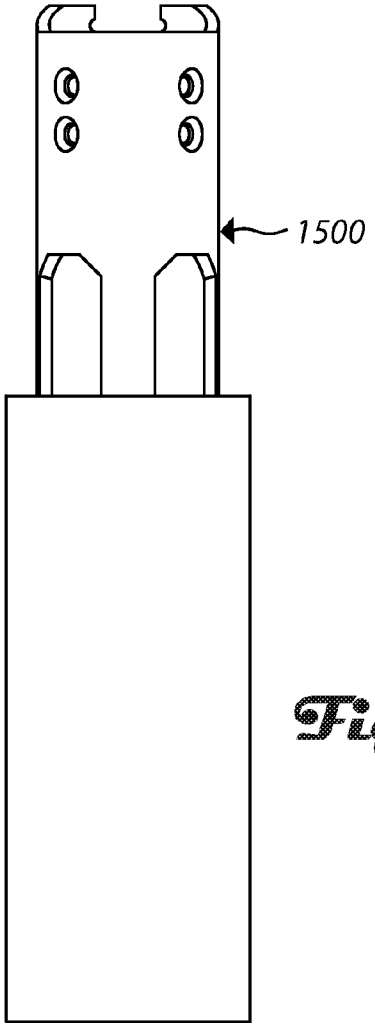
FIG. 17 illustrates a bottom view of a free float dual internal accessory mount in accordance with at least one embodiment.

Referring to FIG. 17, a bottom view of free float dual internal accessory mount 1500 is shown according to one embodiment. In other embodiments, free float dual internal accessory mount 1500 could include grip enhancing feature 95 shown in FIG. 1. In other embodiments, free float dual internal accessory mount 1500 could include heat dispersion features 70 such as shown in FIG. 1.

Figure 18:
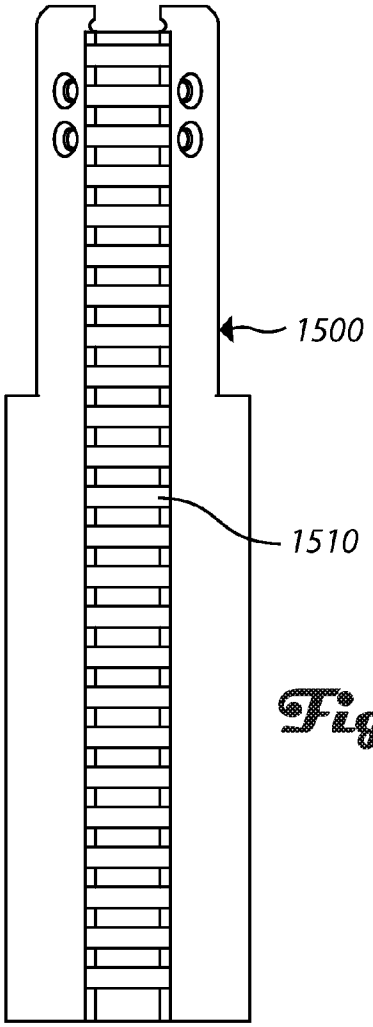
FIG. 18 illustrates a top view of a free float dual internal accessory mount in accordance with at least one embodiment.

Referring to FIG. 18, a top view of free float dual internal accessory mount 1500 is shown according to one embodiment. In one embodiment, Picatinny rail 1510 is centered at the top of free float dual internal accessory mount 1500. In other embodiments, Picatinny rail 1510 could be located at the sides, offset from center and/or omitted from Picatinny rail 1510.

Figure 19:
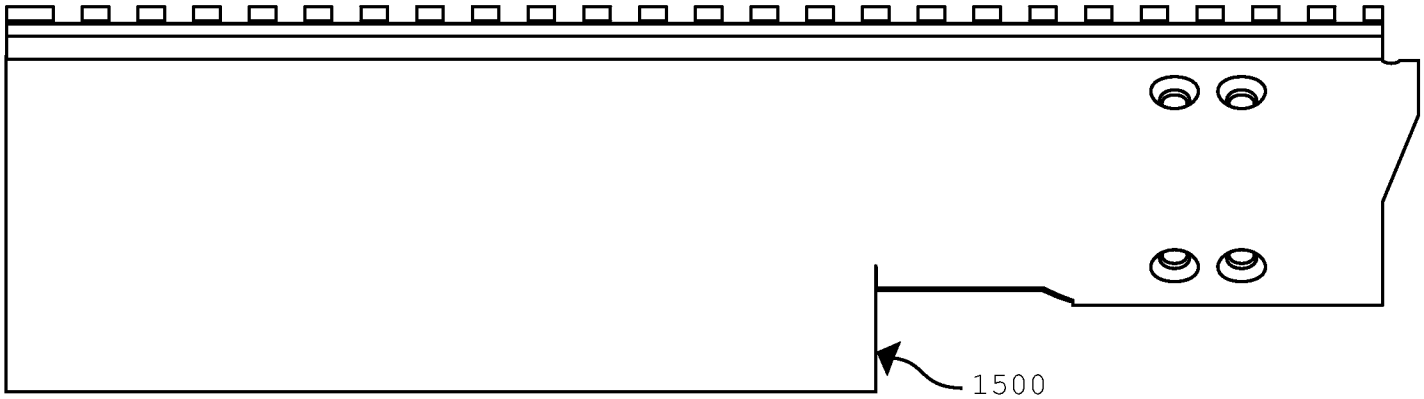
FIG. 19 illustrates a side view of a free float dual internal accessory mount in accordance with at least one embodiment.

Referring to FIG. 19, a side view of free float dual internal accessory mount 1500 is shown according to one embodiment. In one embodiment, free float dual internal accessory mount 1500 provides a lightweight, low profile and snag free mounting solution for up to two head assemblies 850.

Figure 20:
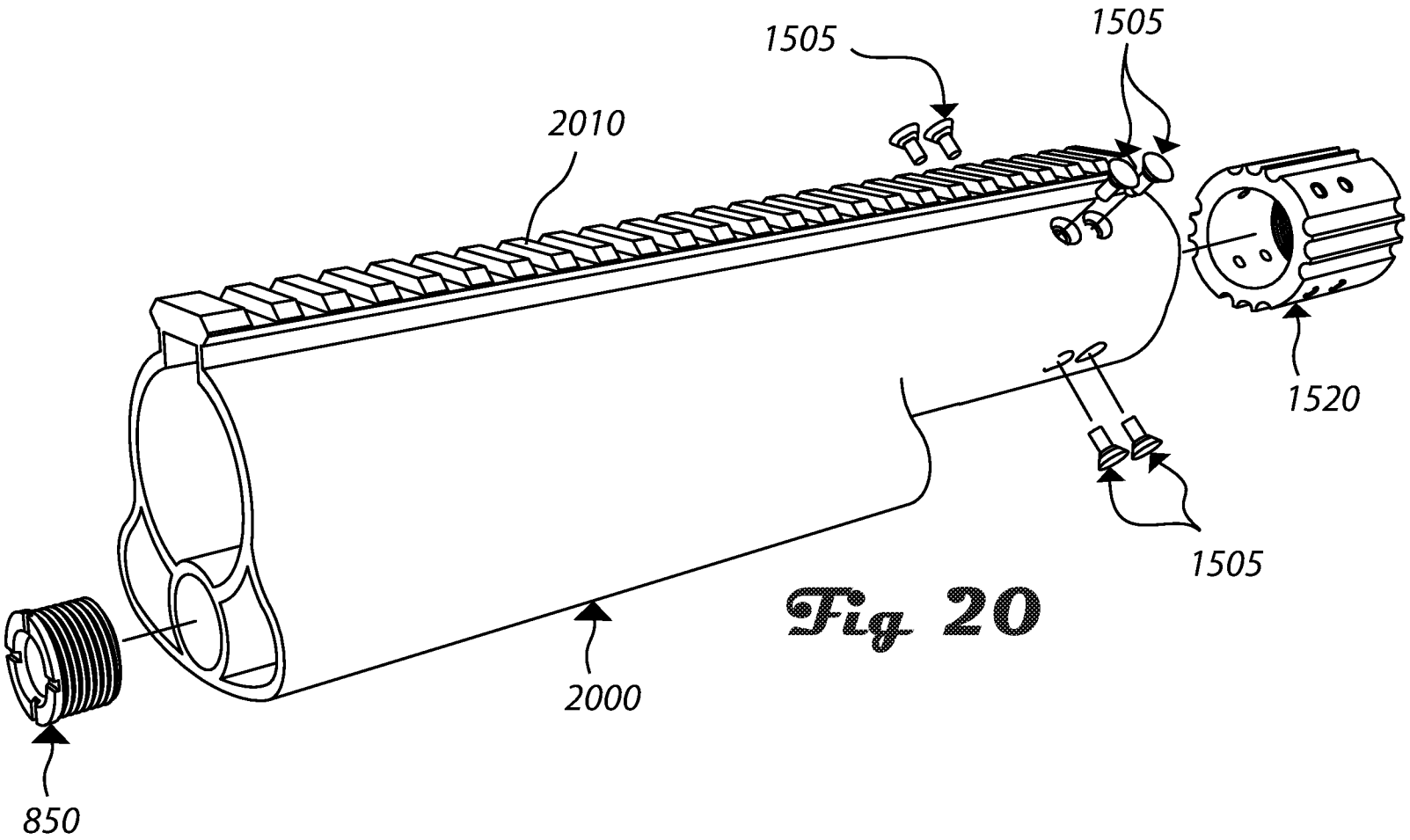
FIG. 20 illustrates an exploded perspective view of a free float single internal accessory mount, a head assembly and barrel nut mounting system in accordance with at least one embodiment.

Referring to FIG. 20, an exploded perspective view of a free float single internal accessory mount 2000 is shown according to at least one embodiment. In one embodiment, the free float single internal accessory mount 2000 includes a two piece head assembly 800, barrel nut screws 1505, tail cap assembly 50, barrel nut 1520 and Picatinny rail 2010. In one embodiment, the free float single internal accessory mount 2000 provides a mounting point for a two piece head assembly 800 devices. In one embodiment, the free float single internal accessory mount 2000 provides a mounting point for one tail cap assembly 50. In one embodiment, free float single internal accessory mount 2000 includes Picatinny rail 2010. In one embodiment free float single internal accessory mount 2000 is affixed to a rifle, airsoft gun, paintball gun, and/or other projectile emitting devices by means of barrel nut 1520 and barrel nut screws 1505. In at least one embodiment, free float single internal accessory mount 2000 can be secured to barrel nut 1520 by cam(s), friction, quick disconnects, set screw(s), adhesive, mechanical attachment or some combination of these. In at least one embodiment, free float single internal accessory mount 2000 could omit Picatinny rail 2020. The free float single internal accessories mount 2000 can be made from at least one of the following materials: metal, polymer, rubber, wood, carbon fiber, fiberglass or some combination of these. The barrel nut 1520 can be made from at least one of the following materials: metal, polymer, rubber, wood, carbon fiber, fiberglass or some combination of these.

Figure 21:
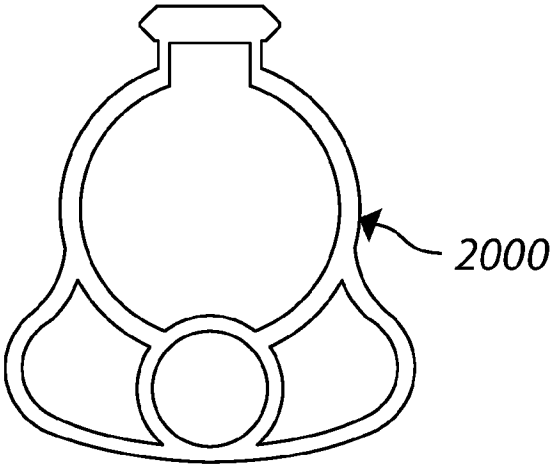
FIG. 21 illustrates a front view of a free float single internal accessory mount in accordance with at least one embodiment.

Referring to FIG. 21, a front view is shown of free float single internal accessory mount 2000 according to one embodiment.

Figure 22:
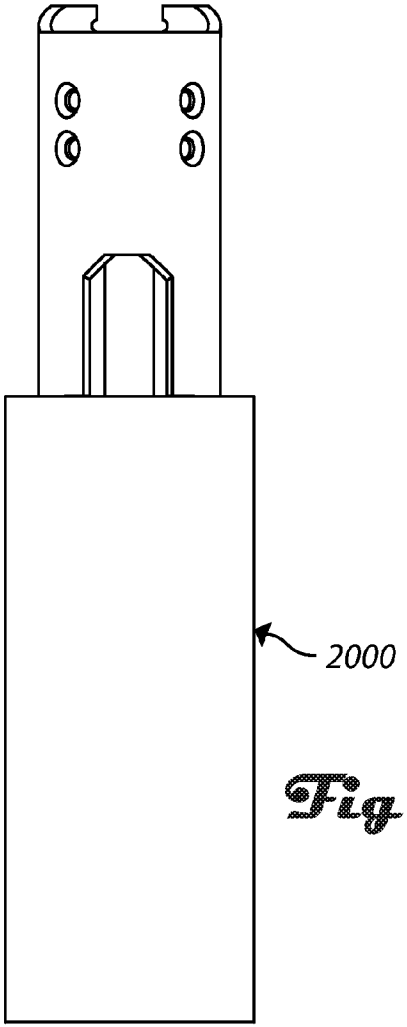
FIG. 22 illustrates a bottom view of a free float single internal accessory mount in accordance with at least one embodiment.
Figure 24:
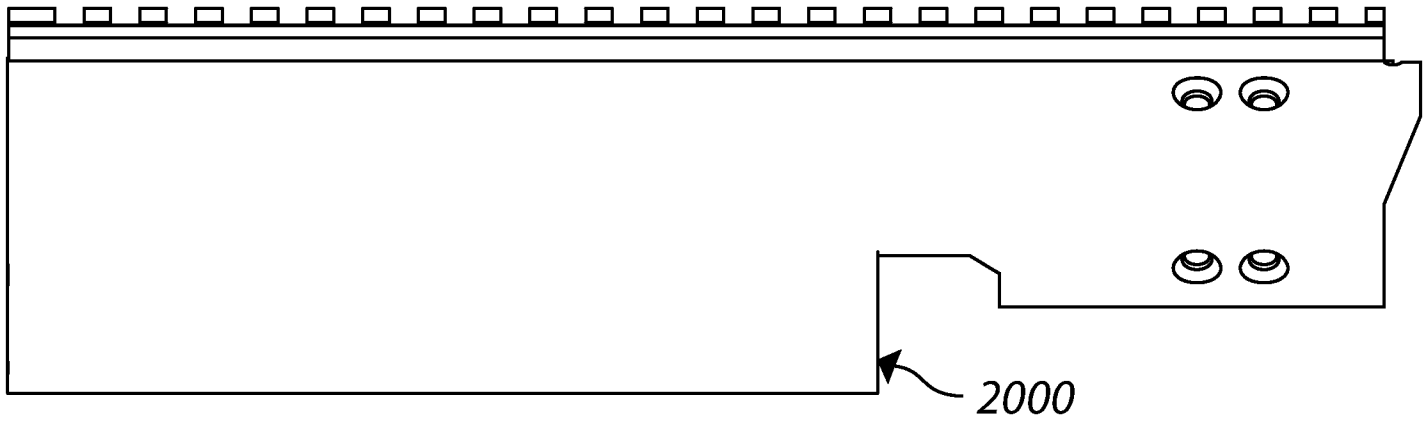
FIG. 24 illustrates a side view of a free float single internal accessory mount in accordance with at least one embodiment.

Referring to FIG. 22, a bottom view of free float single internal accessory mount 2000 according to one embodiment.

Figure 23:
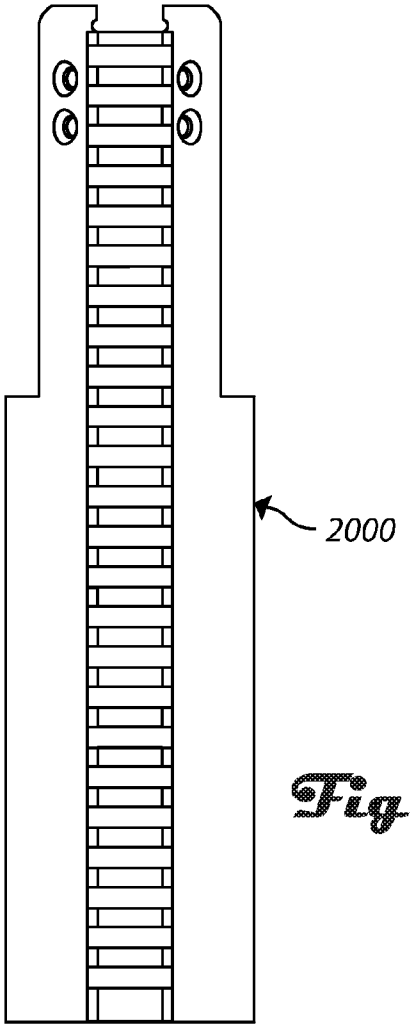
FIG. 23 illustrates a top view of a free float single internal accessory mount in accordance with at least one embodiment.

Referring to FIG. 23, a top view of free float single internal accessory mount 2000 according to one embodiment.

Figure 25:
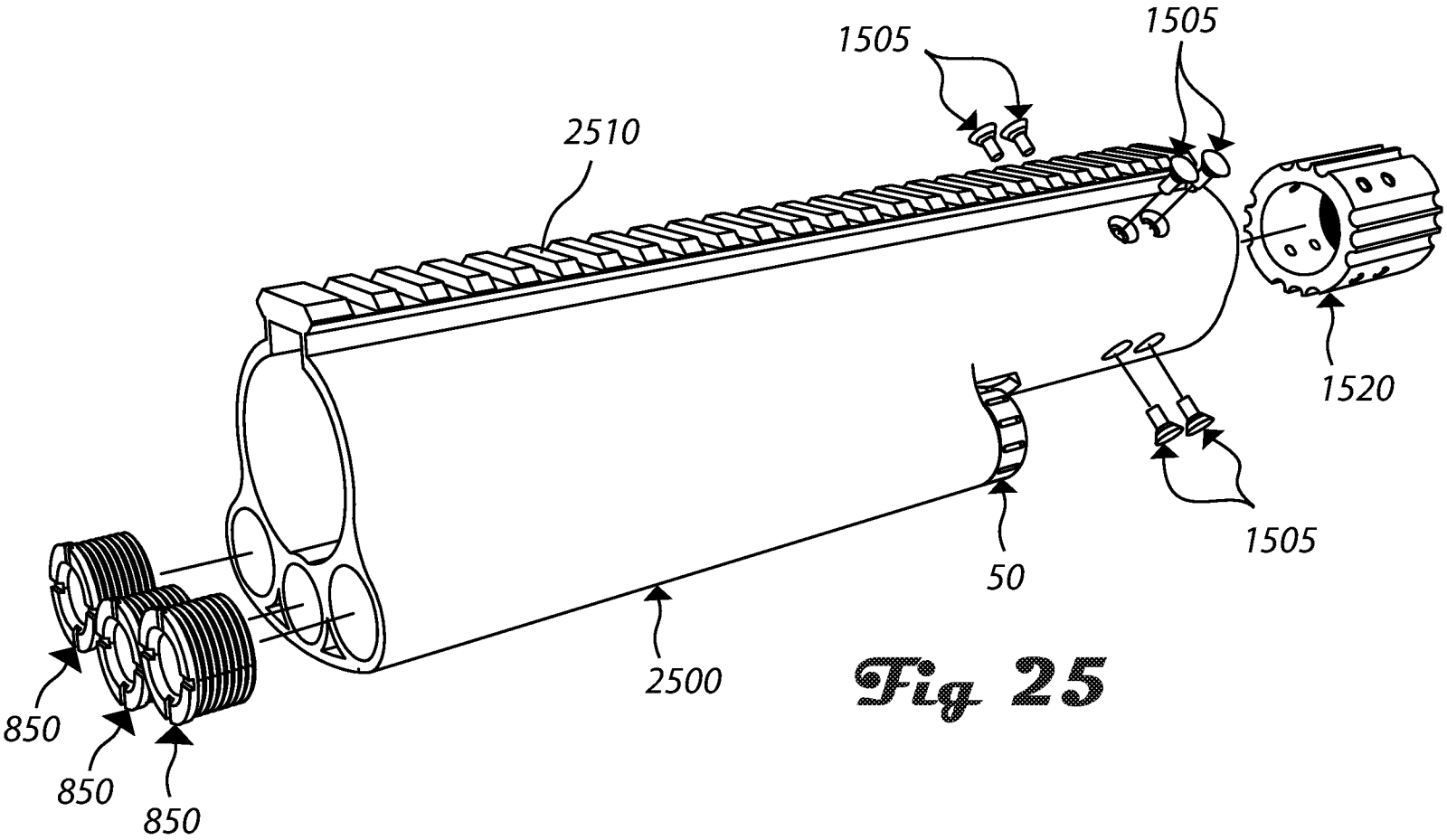
FIG. 25 illustrates an exploded perspective view of a free float triple accessory mount, three head assemblies and a barrel nut mounting system in accordance with at least one embodiment.

Referring to FIG. 25, an exploded perspective view is shown of a free float triple internal accessory mount 2500. In one embodiment, the free float triple internal accessory mount 2500 includes three two piece head assembly 850, barrel nut screws 1505, three tail cap assembly 50, a barrel nut 1520 and a Picatinny top rail 2510. In one embodiment, the free float triple internal accessory mount 2500 provides up to three mounting points for different two piece head assembly 800 devices. In one embodiment, three mounting points parallel to the axis of the barrel gives a multitude of low profile, snag free accessory choices. In one embodiment, the free float triple internal accessory mount 2500 provides up to three mounting points for tail cap assembly 50 devices. In one embodiment, the free float triple internal accessory mount 2500 also includes a Picatinny top rail 2510. In one embodiment, the free float triple internal accessory mount 2500 is affixable to a rifle, airsoft gun, paintball gun, and/or other projectile emitting device by means of a barrel nut 1520 and barrel nut screws 1505. In at least one embodiment, the free float triple internal accessory mount 2500 provides up to three mounting points for each head assembly 30 (not shown). In at least one embodiment, the free float triple internal accessory mount 2500 can be secured to barrel nut 1520 by cam(s), friction, quick disconnects, set screw(s), adhesive, mechanical attachment or some combination of these. In at least one embodiment, the free float triple internal accessory mount 2500 could omit Picatinny rail 2520. The free float triple internal accessories mount 2500 can be made from at least one of the following materials: metal, polymer, rubber, wood, carbon fiber, fiberglass or some combination of these. In one embodiment, the barrel nut 1520 is made from at least one of the following materials: metal, polymer, rubber, wood, carbon fiber, fiberglass or some combination of these.

Figure 26:
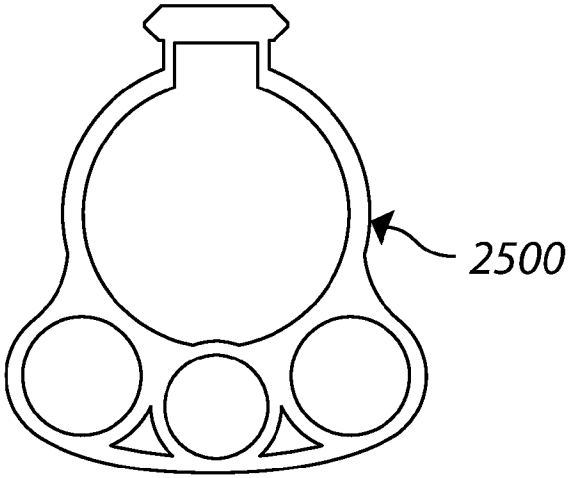
FIG. 26 illustrates a front view of a free float triple internal accessory mount in accordance with at least one embodiment.

Referring to FIG. 26, a front view is shown of free float triple internal accessory mount 2500 according to one embodiment.

Figure 27:
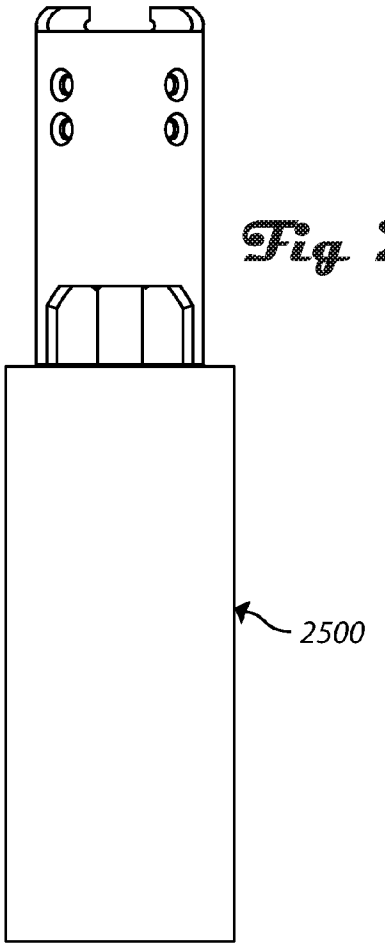
FIG. 27 illustrates a bottom view of a free float triple internal accessory mount in accordance with at least one embodiment.

Referring to FIG. 27, a bottom view is shown of free float triple internal accessory mount 2500 according to one embodiment.

Figure 28:
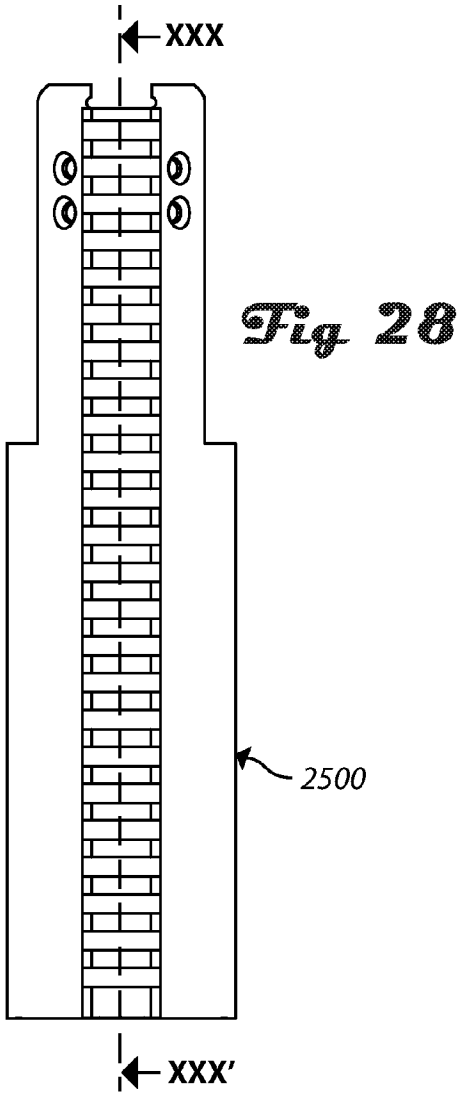
FIG. 28 illustrates a top view of a free float triple internal accessory mount in accordance with at least one embodiment.

Referring to FIG. 28, a top view is shown of free float triple internal accessory mount 2500 according to one embodiment.

Figure 29:
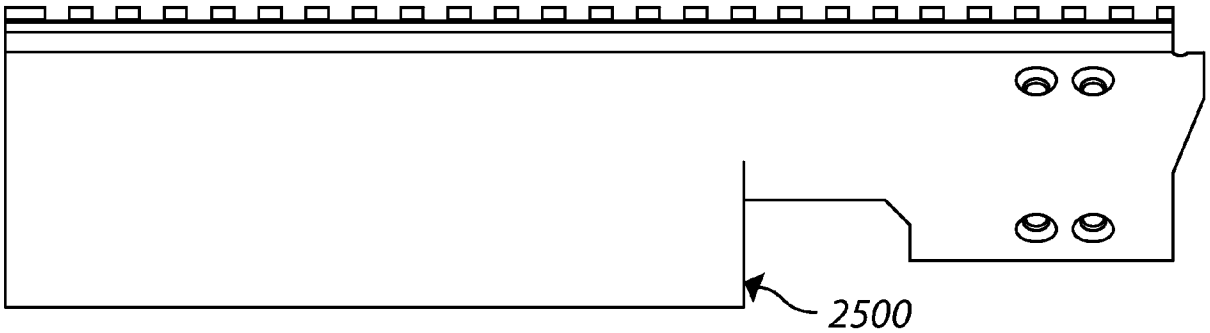
FIG. 29 illustrates a side view of a free float triple internal accessory mount in accordance with at least one embodiment.

Referring to FIG. 29 a side view is shown of free float triple internal accessory mount 2500 according to one embodiment.

Figure 30:
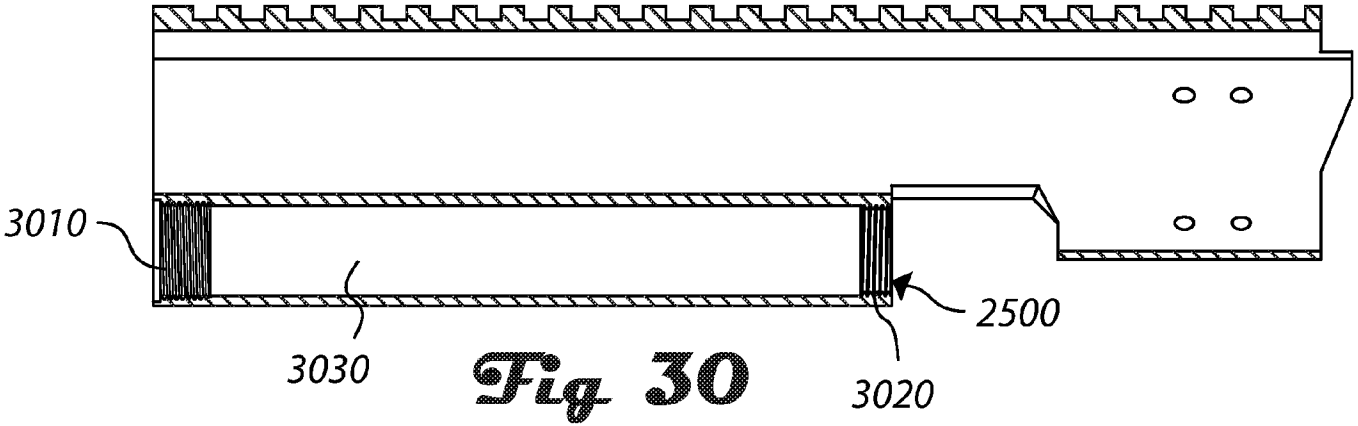
FIG. 30 illustrates a cross sectional side view of a free float triple internal accessory mount taken along section XXX-XXX' in FIG. 28 in accordance with at least one embodiment.

Referring to FIG. 30, a cross sectional side view of the free float triple internal accessory mount 2500 taken along section XXX-XXX' in FIG. 28 is shown in accordance with one embodiment. The free float triple internal accessory mount 2500 includes a cross-sectional view of a front accessory interface 3010, a rear accessory interface 3020 and an accessory mount interior 3030 according to one embodiment. In one embodiment, front accessory interface 3010 shows a threaded interface for a two piece head assembly 850 to mount to. In other embodiments, front accessory interface 3010 could be cam(s), friction, quick disconnects, set screw(s), adhesive, mechanical attachment or some combination of these. In one embodiment, rear accessory interface 3020 shows a threaded interface for a tail cap assembly 50. In other embodiments, rear accessory interface 3020 could be cam(s), friction, quick disconnects, set screw(s), adhesive, mechanical attachment or some combination of these. In one embodiment, rear accessory interface 3020 shows a threaded interface for a tail cap assembly 50. In one embodiment, accessory mount interior 3030 provides a cavity for batteries 31 (not shown). In other embodiments, accessory mount interior 3030 could hold additional accessories, such as wires, accessories, electronics, aiming devices, projectile(s), energy sources, liquids, gases, weapons, hearing protection, ammunition and provide storage space. In at least one other embodiment, accessory mount interior 3030 could be left empty.

Although specific embodiments have been illustrated and described herein, a whole variety of alternate and/or equivalent implementations may be substituted for the specific embodiments shown and described without departing from the scope of the present disclosure. This application is intended to cover any adaptations or variations of the embodiments discussed herein.

The invention claimed is:

1. A fore-end hand guard apparatus for use on a firearm having a barrel comprising:

a free float hand guard body portion with at least two internal accessory mounts radially positioned about an axis of the barrel; and at least two assemblies, each assembly encapsulated and secured within one of the internal accessory mounts by a fixture.

2. The hand guard apparatus of claim 1, wherein an external surface of the at least two internal accessory mounts forms a hand grip on a lower portion of the free float hand guard body portion.

3. The hand guard apparatus of claim 1, wherein the at least two assemblies include a head assembly and a tail cap assembly.

4. The hand guard apparatus of claim 3, wherein the head assembly further comprises a lens cover, a lens, and an illumination package.

5. The hand guard apparatus of claim 4, wherein the tail cap assembly further comprises a battery electrically connected to the illumination package.

6. The hand guard apparatus of claim 3, wherein the head assembly is selected from the group consisting of aim assisting device(s), global positioning devices(s), marking indicators(s), signal emitting devices(s), transponder(s), projectile device(s), and sensor(s).

7. The hand guard apparatus of claim 1, wherein the tail cap assembly further comprises a rear accessory fixture, a switch package, and a switch cover.

8. The hand guard apparatus of claim 1, wherein the tail cap assembly is selected from the group consisting of electronic adapters, remote switch interfaces, pressure switch, electrical plugs, waterproof plugs, switching devices, sensors, aim assist devices, global position device(s), marking indicators, signal emitting devices, transponders, external power adapters, and projectile devices.

9. The hand guard apparatus of claim 1, wherein the free float hand guard body portion includes a grip, at least two front internal mountings, at least two rear internal mountings, and a heat dispersion system.

10. The hand guard apparatus of claim 1, wherein material(s) for the free float hand guard body portion are selected from the group of materials consisting of metal, polymer, rubber, wood, carbon fiber, and fiberglass.

11. A hand guard accessory internal mounting system comprising:

a firearm with a barrel;

a free float hand guard with at least two internal accessory mounts radially aligned about an axis of the barrel; and at least two assemblies, each assembly encapsulated and secured within one of the internal accessory mounts by a fixture.

12. The hand guard accessory internal mounting system of claim 11, wherein an external surface of the at least two internal accessory mounts forms a hand grip on a lower portion of the hand guard.

13. The hand guard accessory internal mounting system of claim 11, wherein the at least two assemblies include a head assembly and a tail cap assembly.

14. The hand guard accessory internal mounting system of claim 13, wherein the head assembly includes a front fixture, a lens cover, lens, and an optical electronic package.

15. The hand guard accessory internal mounting system of claim 13, wherein the tail cap assembly further comprises a rear fixture, a switch package, and a switch cover.

16. The hand guard accessory internal mounting system of claim 15, wherein the tail cap assembly further comprises a battery and a switch to activate and deactivate connected devices.

* * * * *